US006736264B2

(12) United States Patent
Yoshida

(10) Patent No.: US 6,736,264 B2
(45) Date of Patent: May 18, 2004

(54) GOLF BAG AND FRAME FOR THE SAME

(75) Inventor: Satoshi Yoshida, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/379,266

(22) Filed: Mar. 4, 2003

(65) Prior Publication Data

US 2003/0168362 A1 Sep. 11, 2003

(30) Foreign Application Priority Data

Mar. 6, 2002 (JP) ..... 2002-060599
Dec. 26, 2002 (JP) ..... 2002-376806

(51) Int. Cl.[7] ..... A63B 55/00
(52) U.S. Cl. ..... 206/315.7; 206/315.3; 248/96
(58) Field of Search ..... 206/315.3, 315.7, 206/315.8; 248/96

(56) References Cited

U.S. PATENT DOCUMENTS

| | | | | | |
|---|---|---|---|---|---|
| 1,657,170 | A | * | 1/1928 | McLaren | 248/96 |
| 1,678,922 | A | * | 7/1928 | Singer | 248/96 |
| 1,757,471 | A | | 5/1930 | Platt | |
| 1,880,351 | A | * | 10/1932 | McDonald | 248/96 |
| 2,751,176 | A | * | 6/1956 | Mowry | 248/96 |
| 3,075,733 | A | * | 1/1963 | Kimmel | 248/96 |
| 3,191,900 | A | * | 6/1965 | Cayot | 248/96 |
| 3,532,313 | A | * | 10/1970 | Brayton | 248/96 |
| 4,798,357 | A | * | 1/1989 | Cho | 248/96 |
| 4,834,235 | A | | 5/1989 | Solheim et al. | |
| 4,921,192 | A | | 5/1990 | Jones | |
| 5,314,063 | A | | 5/1994 | Lee et al. | |
| 5,678,791 | A | * | 10/1997 | Maeng | 248/96 |
| 5,762,189 | A | * | 6/1998 | Reimers | 206/315.7 |
| 5,829,719 | A | | 11/1998 | Han | |
| 5,857,567 | A | | 1/1999 | Cheng | |
| 6,220,433 | B1 | | 4/2001 | Kang | |

FOREIGN PATENT DOCUMENTS

| | | | | |
|---|---|---|---|---|
| AU | 156107 | * | 7/1951 | 206/315.6 |
| GB | 2098075 A | * | 11/1982 | A63B/55/06 |
| JP | 02-034181 | | 2/1990 | |
| JP | 03-118087 | | 5/1991 | |
| JP | 05-200133 | | 8/1993 | |
| JP | 2563737 | | 7/1994 | |
| JP | 2001198250 A | | 7/2001 | |

* cited by examiner

*Primary Examiner*—Sue A. Weaver
(74) *Attorney, Agent, or Firm*—Troutman Sanders LLP; Gerald R. Boss

(57) ABSTRACT

A golf bag has a body and a frame. The frame receiving the body includes a strut portion, a bottom connecting portion, a pressing member rotatably attached to the bottom connecting portion, a resilient member having one end connected to the pressing member, and a support member connected to the other end of the resilient member and driven by being pressed via the resilient member by the pressing member. The pressing member is placed below a bottom curved portion of the frame.

16 Claims, 16 Drawing Sheets

GOLF BAG AND FRAME FOR THE SAME

BACKGROUND OF THE INVENTION

1. Field of the Invention

The present invention relates to golf bags (caddy bags) for holding golf clubs therein and frames for the golf bags. In particular, the present invention relates to a golf bag having a retractable support member and to a frame therefor.

2. Description of the Background Art

A first example of conventional golf bags having a support member is disclosed for example in Japanese Patent Laying-Open No. 5-200133. This golf bag includes an actuation member extending outward from the base of the body and a branch section connected to the actuation member to open the stand. Golf bags similar to the golf bag of this type are disclosed for example in Japanese Utility Model Registration No. 2,563,737 and U.S. Pat. No. 1,757,471.

A second example of conventional golf bags is disclosed in U.S. Pat. No. 6,220,433. The bottom of the body of this golf bag has an inclined surface. In parallel with the inclined surface, a pressing member is pivotally attached to the bottom. An elastic link member connected to the pressing member opens the support member. Golf bags similar to the golf bag of this type are disclosed for example in U.S. Pat. Nos. 5,829,719, 4,921,192 and 5,857,567 and Japanese Patent Laying-Open No. 3-118087.

A third example of conventional golf bags is disclosed for example in Japanese Patent Laying-Open No. 2-34181. The base of the body of this golf bag is collapsible and a toggle mechanism is provided for pushing up the stand when the base of the body is partially collapsed. A golf bag similar to this golf bag is disclosed in U.S. Pat. No. 4,834,235.

A fourth example of conventional golf bags is shown in FIG. 16 having a frame 3 for supporting the body. As shown in FIG. 16, frame 3 includes a movable pressing member 4, a resilient member 5 connected to pressing member 4 and a support member 6 connected to resilient member 5. For this golf bag, pressing member 4 is attached to extend outward from frame 3, and support member 6 is driven by this pressing member 4.

The examples of the conventional golf bags have respective problems discussed below.

Regarding the first example, as the actuation member is located outside the outer surface of the body of the golf bag, the actuation member is likely to undergo excessive impact. Then, there arises a problem that the actuation member is easily damaged.

Regarding the second example, as the bottom of the body has the inclined surface, the pressing member could suddenly be subjected to a load when the golf bag is inclined. Therefore, the pressing member and any part supporting the pressing member are easily damaged.

Regarding the third example, as the base of the body of the golf bag has to be collapsed each time the stand is used, the base of the body is easily damaged. A resultant problem is a shortened lifetime of the golf bag. An additional problem is that the golf bag cannot be self-supported without the stand.

Regarding the fourth example, as the pressing member is attached to extend outward from the frame, a problem of this example is that the pressing member is easily damaged.

SUMMARY OF THE INVENTION

The present invention has been made to solve the problems discussed above. One object of the present invention, i.e., a golf bag having a retractable support member, is to prevent damage to a drive member for driving the support member and damage to a supporting component for supporting the drive member and further to prevent shortening of the lifetime of the golf bag due to use of the support member.

A golf bag according to the present invention includes a body, a frame receiving the body and having a bottom portion provided with at least a pair of first curved portions, a pressing member attached to the bottom portion of the frame, a resilient member having one end connected to the pressing member, and a support member connected to the other end of the resilient member and driven by being pressed via the resilient member by the pressing member. The pressing member is placed below the first curved portions. The pressing member may rotatably be attached to the bottom portion of the frame or may be secured to the bottom portion of the frame and deformable.

As the pressing member is provided below the first curved portions of the bottom portion of the frame, the pressing member as well as the mount portion where the pressing member is mounted are protected by the frame. In addition, as the first curved portions are provided to the bottom portion of the frame, the golf bag is gradually inclined on and along the first curved portions. Here, as the pressing member is located below the first curved portions, load is gradually applied to the pressing member to rotate or deform the pressing member. Load is thus prevented from being applied abruptly to the pressing member when the golf bag is inclined. Moreover, as the pressing member is used to drive the support member, it is unnecessary to collapse the bottom portion of the body of the golf bag.

Preferably, the frame has a second curved portion forming a space for holding the support member in the space.

As the space is provided in which the support member is held, the support member as well as any component to which the support member is attached are protected by the frame. Further, depending on the shape for example of the second curved portion, damage to the support member is prevented, the damage being caused when the golf bag is laid horizontally on the ground with the support member facing the ground and accordingly the support member is brought into contact with the ground.

Preferably, the frame has first and second struts extending continuously from the bottom portion. Here, the first curved portions are provided respectively to respective connection parts between the first and second struts and the bottom portion. The golf bag is thus inclined on and along the paired first curved portions in a stable manner.

Preferably, the body has a tape stretched between a top portion and the bottom portion of the frame for maintaining a shape of the body. Still preferably, the golf bag further includes a connection member for connecting the tape and the frame to each other. Then, the shape of the body of the golf bag is maintained by means of the frame. Moreover, by means of the tension of the tape and a pad, direct contact of the frame with the body of a user may be avoided.

Preferably, the body is detachably attached to the frame. Thus, when one of the body and frame is damaged, only that damaged one may be replaced with a new one and thus easy and low-cost repair of the golf bag is possible.

Preferably, the golf bag includes a side tape having both ends secured to a side of the body and having a length adjuster adjusting the length to apply tension to the body. The body preferably has its side provided with a pocket, and the side tape is preferably placed within the pocket.

Preferably, the golf bag further includes a partition attached to a top opening portion of the body. Here, the partition preferably has an engagement portion engaged detachably with a top portion of the frame. Preferably, the body has a through hole through which the partition is inserted. In this case, a reinforcement portion is preferably provided around the through hole.

Preferably, a plurality of legs are attached to the bottom portion of the frame and the legs and the body are detachably connected to each other via respective connection members.

Preferably, the golf bag further includes a first protection member attached to a first curved portion for protecting the first curved portion, and the first protection member has a first protrusion serving as a leg when the body and the frame are laid horizontally. The frame preferably has first and second struts extending continuously from the first curved portions respectively and a first connecting portion connecting the first and second struts to each other near a top portion of the frame. Here, a second protection member is preferably attached to the first connecting portion, and the second protection member preferably has a second protrusion serving as a leg when the body and the frame are laid horizontally.

Preferably, the frame has first and second struts extending continuously from the first curved portions respectively and a second connecting portion connecting the first and second struts to each other above the first curved portions. Here, the resilient member preferably extends on a side opposite to the support member with respect to the second connecting portion.

According to the present invention, a frame receiving a body of a golf bag includes at least a pair of first curved portions provided to a bottom portion, a connecting portion provided to the bottom portion, a pressing member placed below the first curved portions and attached to the connecting portion, a resilient member having one end connected to the pressing member, and a support member connected to the other end of the resilient member and driven by being pressed via the resilient member by the pressing member.

By using the frame having the above-described structure for a golf bag, the pressing member as well as the mount portion where the pressing member is placed are protected by the frame and the pressing member is rotated or deformed by being gradually applied with load. Any load applied suddenly to the pressing member when the golf bag is inclined is thus avoided. Moreover, it is unnecessary to collapse the bottom portion of the body of the golf bag for driving the support member.

Preferably, the frame further includes a second curved portion forming a space for holding the support member in the space. The space where the support member is held is thus secured and accordingly the support member and any component to which the support member is attached are protected by means of the frame.

Preferably, the frame further includes first and second struts extending continuously from the bottom portion. Here, the first curved portions are provided respectively to respective connection parts between the first and second struts and the bottom portion. Accordingly, the golf bag is stably inclined on and along the first curved portions.

Preferably, the frame further includes a first protection member attached to a first curved portions for protecting the first curved portion, a first connecting portion connecting the first and second struts to each other near a top portion of the frame, and a second protection member attached to the first connecting portion. Here, the first protection member preferably has a first protrusion serving as a leg when the frame is laid horizontally, and the second protection member preferably has a second protrusion serving as a leg when the frame is laid horizontally.

Preferably, the frame further includes a second connecting portion connecting the first and second struts to each other above the first curved portions. Here, the resilient member preferably extends on a side opposite to the support member with respect to the second connecting portion.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
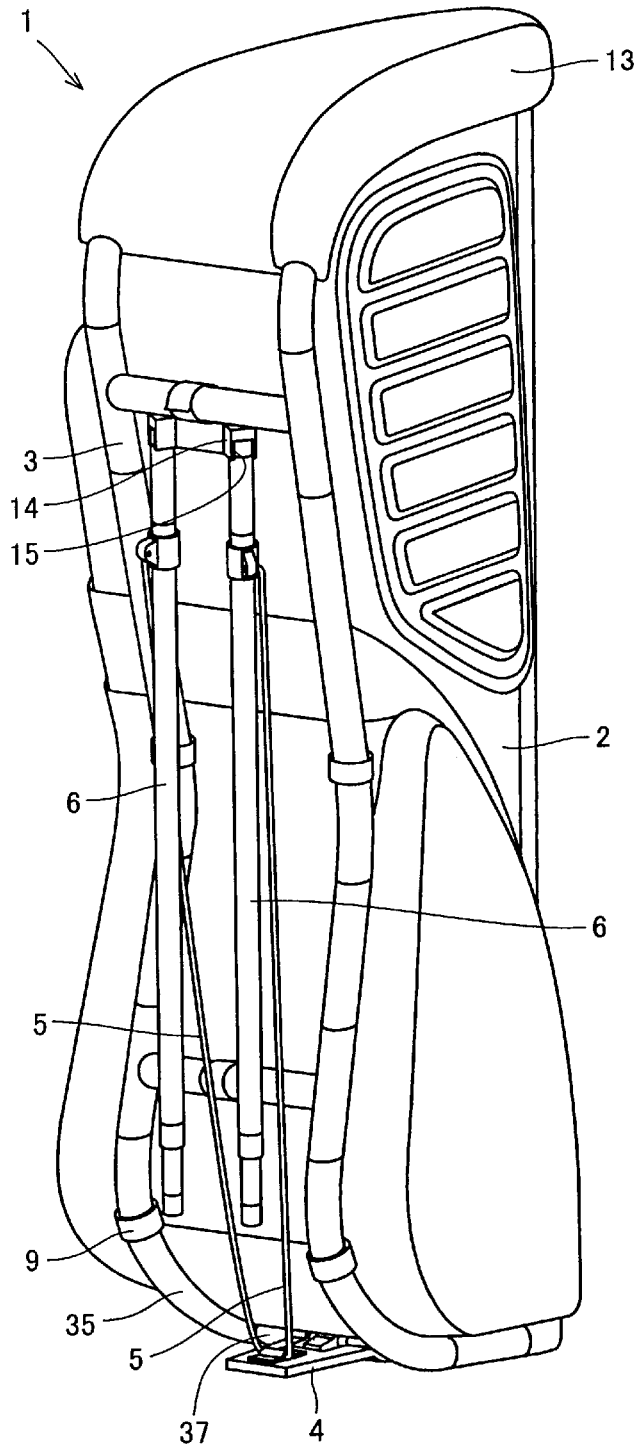
FIG. 1 is a perspective view of a golf bag according to one example of the present invention.

According to one embodiment, a golf bag (caddy bag) includes a tubular body holding golf clubs therein and a frame receiving the body. Typically, most part of the body of the golf bag is made of cloth and the body is inserted to the frame and secured thereto in the inserted state.

Preferably, the body has a shape retention member stretched or connected between the top and bottom of the frame for maintaining the shape of the body. A tape made of a material having a predetermined strength, for example, a cloth tape or rubber material may be employed as the shape retention member.

Preferably, the body of the golf bag has a connection member for connecting the tape and frame to each other. A cloth member having a length adjuster for example may be used as the connection member. The tape and connection member are provided as described above to maintain the shape of the body of the golf bag by using the frame.

Further, the body of the golf bag is attachable to the frame merely by securing the connection member to the frame and the body of the golf bag is easily detachable from the frame merely by removing the connection member from the frame. The body of the golf bag is thus easily attachable to and detachable from the frame. Therefore, if one of the body and the frame is damaged, only the damaged one is easily replaceable with a new one and thus easy and low-cost repair of the golf bag is possible.

In addition, a side tape (belt-shaped member) serving as tension-applying means for applying tension to the body of the golf bag is preferably attached to a side of the body of the golf bag. The side tape has its longitudinal ends secured to the side of the body of the golf bag and has a length adjuster for adjusting the length thereof. This side tape as described above applies a desired tension to the body of the golf bag by adjusting the length of the side tape with the length adjuster. In this way, the shape of the body of the golf bag is maintained.

The side tape extends in the vertical direction of the body of the golf bag (longitudinal direction of the body) and preferably side tapes are sewn to both lateral sides of the body of the golf bag. One side tape or a plurality of side tapes may be provided, however, preferably a plurality of side tapes are attached, on each of the lateral sides of the body, in substantially parallel with each other in the direction of the width of the body of the golf bag (in the direction of the periphery of the body). Accordingly, tension is applied to the body of the golf bag at a plurality of places in the direction of width (periphery) of the body and thus a superior shape retention function for the body of the golf bag is achieved.

In addition, reinforcing members are preferably attached to longitudinal ends of the side tapes for improving the strength with which the side tapes are attached to the body of the golf bag. As the reinforcing members, band-shaped cloth members may be used that extend in the direction orthogonal to the direction in which the side tapes extend or in the direction crossing the side tapes. The reinforcing members extend over the longitudinal ends of the side tapes and sewn to the lateral side of the body of the golf bag.

Preferably, the body of the golf bag has a pocket on its side in which various articles such as golf balls may be held. One pocket or a plurality of pockets may be provided, however, typically two side pockets are provided on both sides respectively of the body of the golf bag. Another pocket, i.e., a center pocket may further be provided between the two side pockets on the front of the golf bag.

The center pocket is preferably provided detachably to the body of the golf bag via a fastener for example. One strut of the frame may be provided between the center pocket and the body of the golf bag to allow the center pocket to serve as a connection part between the body of the golf bag and the frame.

The above-discussed side tapes are preferably provided within the side pockets as described above. For example, longitudinal ends of the side tapes may be sewn to each of the lateral sides of the body of the golf bag within respective side pockets. As the side tapes are provided within the side pockets, the side tapes are hidden from view when the pockets are closed and thus the external appearance of the golf bag is prevented from being impaired. Preferably, a plurality of side tapes are attached substantially in parallel with each other within the same pocket.

Preferably, the golf bag of this embodiment has a partition attached to the throat (top opening) of the body. The partition divides the space within the throat of the body of the golf bag into a plurality of regions and, golf clubs are accordingly inserted into and held within the golf bag through a plurality of openings thus produced by the partition.

The partition is made of plastic for example and extended across the throat of the body of the golf bag. The shape of the partition may be any arbitrary one. An H-shaped partition for example may be employed for producing an appropriate number of regions by partitioning.

The partition has an engagement portion which is engaged detachably with an upper part of the frame. The engagement portion is provided on an end of the partition and is hook-shaped, curved, or flat plate in shape, for example. Any engagement portion in a shape except for the mentioned ones may be employed if the engagement portion can be engaged with the frame. The engagement portion may be integrated with the body of the partition or a separate engagement portion may be attached to an end of the body of the partition.

Moreover, the engagement portion of the partition and the frame may simply be engaged with each other or the engagement portion of the partition may be attached detachably to the frame with such fastening members as screws. Further, a receiving portion like a recess for receiving the engagement portion may be provided to the frame for preventing the engagement portion from being displaced after the engagement portion of the partition and the frame are engaged with each other.

The body of the golf bag has a through hole for allowing an end of the partition to be inserted therethrough. Through the through hole, the end of the partition and its nearby part may be extended from the inside to the outside of the body of the golf bag and the partition and the frame may be engaged with each other. A reinforcing portion is desirably provided around the through hole in the body of the golf bag. The region around the through hole is thus reinforced for preventing a part of the body of the golf bag that is located around the through hole from being damaged.

The frame of the golf bag of this embodiment has significant characteristics, namely that the frame is formed of a hard material, has a curved portion at the bottom thereof and has a pressing member provided below the curved portion as described herein later.

The frame is easily assembled from metal pipes in a predetermined shape for example. Other than the metal, any arbitrary material such as FRP (Fiberglass Reinforced Plastic) and plastic for example may be employed as a material for the frame on the condition that the material meets a required strength for the frame.

The frame typically has a top portion, bottom portion and a strut connecting the top portion and the bottom portion. The body of the golf bag is received in the space formed by the top portion, bottom portion and strut.

The top portion of the frame is connected to the top of the body of the golf bag and the bottom portion of the frame supports the bottom of the body of the golf bag. The strut extends in the vertical direction along the lateral sides of the body.

Preferably, for weight reduction, the top portion and the bottom portion of the frame extend along respective perimeters of the top and bottom of the body of the golf bag, and the regions respectively enclosed by these top portion and bottom portion are hollow. For example, if metal pipes are employed to form the frame, the metal pipes are curved to form top and bottom portions respectively of the frame.

A plurality of legs are attached to the bottom portion of the frame and the legs and the body of the golf bag are detachably connected via connection members. Legs made of plastic for example may be attached to the bottom of the frame. The legs could be in any of various shapes. A curved member having a substantially C-shaped cross section or in the shape of the hook may be employed as a leg.

The legs are attached to the bottom portion of the frame at predetermined intervals and each have a connection part connected to the connection member. For example, a part of the leg may be provided with a through hole receiving the connection member or engagement portion.

As the connection member, a cloth tape for example may be used. If the tape is employed as the connection member, the tape may be inserted through the through hole to connect the connection member to the leg and ends of the tape may be secured to the body of the golf bag.

The legs thus provided to the bottom portion of the frame support the golf bag in a stable manner on the ground (underlying area) and accordingly the golf bag is stably maintained in the standing state (vertically disposed state). In addition, as the frame is not directly in contact with the ground, the frame can be protected.

The strut of the frame extends in the vertical direction, the top end of the strut is connected to the top portion of the frame and the bottom end thereof is connected to the bottom portion of the frame. An arbitrary number of struts may be provided. Preferably, a plurality of struts are provided.

The curved portion (first curved portion) mentioned above is provided at the connecting part between the strut and the bottom portion of the frame. For example, if first and second struts are provided, respective curved portions may be provided at respective lower ends of the first and second struts. Accordingly, the body of the golf bag may gradually be inclined with the frame on and along the curved portions. Preferably, the curved portions have a predetermined or constant curvature.

Preferably, a first protection member is attached to the first curved portion for protecting the first curved portion. The first protection member is made of plastic or synthetic rubber for example and attached to the first curved portion to cover at least a surface of the bottom (surface facing the ground) of the first curved portion. The first protection member may be attached to the first curved portion by utilizing the elasticity of the first protection member itself or using such a fastening member as screw and rivet for securing the first protection member to the first curved portion, for example.

The first protection member has a first protrusion serving as a leg portion when the body and frame of the golf bag are laid horizontally or laterally. The first protrusion is typically provided near the upper end of the first curved portion to jut out backward (e.g. toward the support member 6 shown in FIG. 4).

The above-discussed first protection member is thus attached to the first curved portion to protect the first curved portion and further to prevent the first curved portion from sliding on the ground (underlying area). In addition, the first protrusion is provided to avoid contact between the frame and the ground (underlying area) when the body and frame of the golf bag are laid horizontally.

Preferably, the strut has a curved portion (second curved portion) to form a space in which a support member discussed herein later is held. The curved portion may be provided at a central part of the strut with respect to the vertical direction thereof, for example, to jut out forward from the frame (e.g., toward third strut 34 shown in FIG. 4). In this case, the support member may be held in the space formed by the curved portion and the end sections of the strut that are located behind the curved portion with the curved portion therebetween.

Preferably, connecting portions are provided to the bottom portion and struts. The connecting portion of the bottom portion (bottom connecting portion) is provided to extend across the space defined by components of the bottom portion so as to connect the components to each other. The connecting portion of the struts is provided to connect the struts to each other.

To first and second struts extending continuously from respective first curved portions, a first connecting portion (upper connecting portion) connecting the first and second struts near the top of the frame as well as a second connecting portion (central connecting portion) connecting the first and second struts above and near the first curved portions are provided. Preferably, a second protection member is attached to the first connecting portion.

The second protection member is made of plastic or synthetic rubber for example and attached to a connecting part between the first/second strut and the first connecting portion. As one exemplary shape of the second protection member, the protection member may have a shape having a tubular section partially covering the first connecting portion, a curved section connected to one end of the tubular section and shaped to extend along the periphery of the first/second strut, and a extending section extending downward continuously from the tubular section to be connected to one end of the support member. The second protection member is typically attached to the connecting portion by means of such a fastening member as screw and rivet, for example.

Preferably, the second protection member has a second protrusion serving as a leg when the body and frame of the golf bag are laid horizontally. The second protrusion thus provided protects the frame when the body and frame of the golf bag are laid in the horizontal state. In addition, the second protrusion serves as a support which supports the golf bag when the bag is mounted on a (golf) cart.

The extending section is hollow in shape and partially notched. The support member is rotatably connected to the extending section. A pin for example is inserted from the outside of the extending section through respective ends of the extending section and support member to allow the support member to be rotatable through the notch.

A pressing member is attached to the connecting portion which is provided to the bottom portion of the frame. The pressing member is used for pressing and thereby driving the support member as described later. The pressing member is formed for example of plastic plate or relatively hard rubber plate having flexibility.

As described above, the pressing member is placed below the curved portion of the bottom portion of the frame and is attached to the connecting portion rotatably or deformably. For example, if first and second struts are provided, the pressing member is placed below respective curved portions at the lower sections of the first and second struts. The pressing member and the mount portion where the pressing member is placed are thus protected by the frame.

One end of a resilient (elastic) member is attached to or near the free end of the pressing member. The resilient member serves to transmit the force generated by rotation or deformation of the pressing member to the support member described below. The resilient member may be formed of a material having resiliency, for example, metal wire rod. The other end of the resilient member is connected to the support member discussed below.

The resilient member preferably extends on the opposite side of the support member with respect to the second connecting portion, namely extends in front of (inside) the second connecting member. Accordingly, the resilient member deforms into the shape of an arch when the support member is opened and thus the resilient member applies force to the support member in the direction to return the support member to the retracted state.

As the second connecting portion limits free backward movement of the resilient member, it is possible to prevent the support member from being automatically opened by the own weight of the support member/resilient member when the golf bag is carried, for example, on the shoulder.

Preferably, a connection member is attached that serves to connect resilient members at or near the central portion with respect to the longitudinal direction of the resilient members and hold the resilient members in the state close to each other. Thus, the resiliency is more efficiently exerted on the support member to open/close the support member smoothly.

Support members (stands) supporting the golf bag in the inclined state are attached to the connecting portion (e.g. upper connecting portion) provided to the struts. Typically two support members are provided rotatably with respect to the connecting portion.

The golf bag structured as discussed above is inclined on and along the curved portions (first curved portions) of the bottom portion of the frame, and then the pressing member is pressed against the ground to rotate about the connecting portion or deform. At this time, as the golf bag can be inclined gradually on and along the curved portions, the pressing member may gradually be rotated or deformed. Accordingly, load is prevented from being suddenly applied to the pressing member when the golf bag is inclined.

The pressing member is thus rotated or deformed to push up the resilient members, and the resilient members are accordingly displaced upward relative to the frame. The resilient members then push up the support members which accordingly rotate with respect to the connecting portion provided to the struts of the frame. The support members then open and the leading ends of the support members project in the direction in which the golf bag is inclined. Respective leading ends of the support members are thus brought into contact with the ground and, in this state, support the golf bag.

As the golf bag is raised from the inclined state, the support members return to the place between the struts of the frame while being closed, and the pressing member is rotated in the reverse direction or deformed back into the initial state. At this time, the curved portions (second curved portions) at respective central portions in the longitudinal direction of the struts allow the support members to be held within the space defined by the curved portions. Depending on the shape of the curved portions, the support members may be prevented from being in contact with the ground when the golf bag is laid horizontally on the ground with the support members on the lower side thereof.

The pressing member drives the support members as discussed above, and thus it is unnecessary to collapse the bottom portion of the body of the golf bag. Then, the shortening of the lifetime of the golf bag due to the collapsing of the bottom of the body is avoided.

EXAMPLES

A golf bag and a frame of the golf bag according to one example of the present invention are now described in conjunction with FIGS. 1–7.

Figure 2:
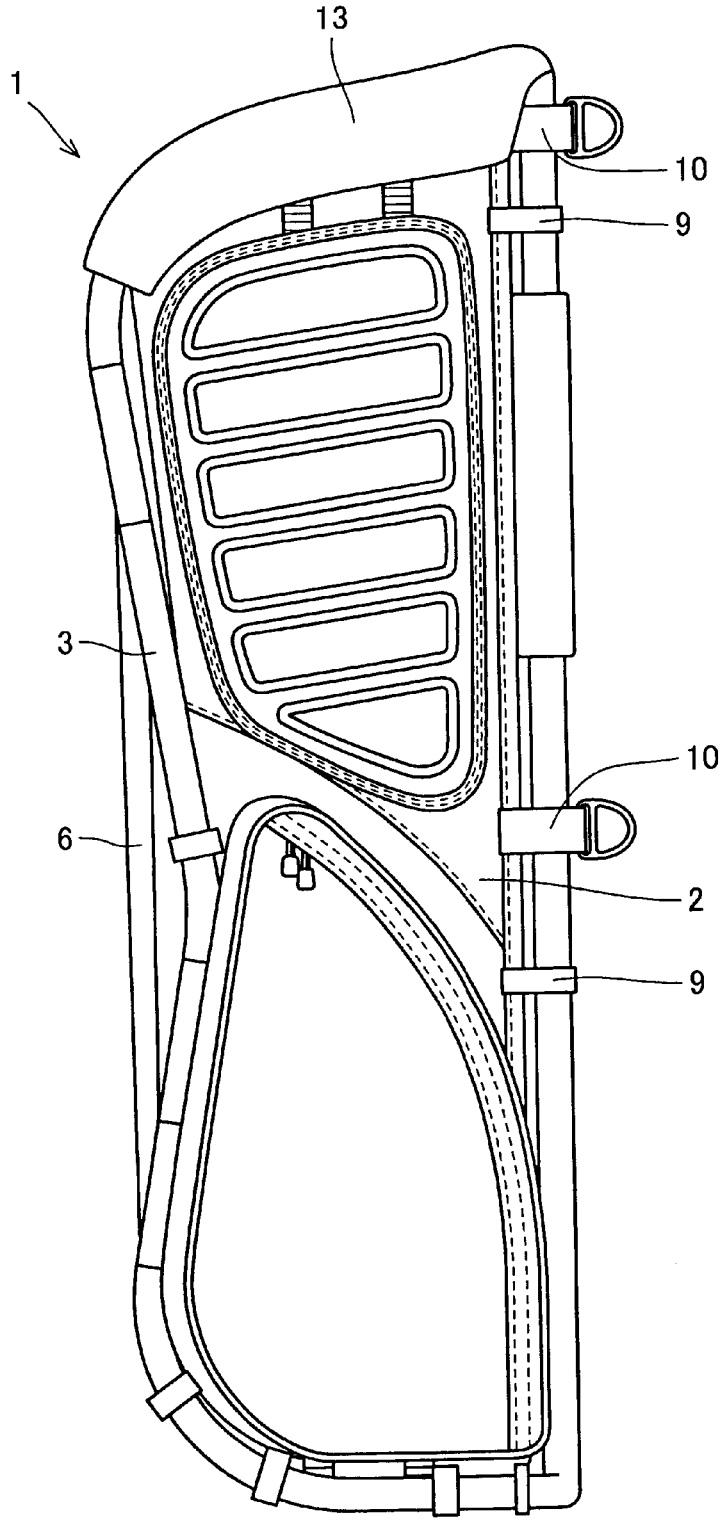
FIG. 2 is a side view of the golf bag in one example of the present invention.

FIG. 1 is a perspective view of a golf bag 1 and FIG. 2 is a side view thereof according to this example. As shown in FIGS. 1 and 2, golf bag 1 includes a body 2 and a frame 3.

According to the example shown in FIGS. 1 and 2, body 2 is inserted into frame 3 to be mounted on the bottom of frame 3. Body 2 is secured to frame 3 via a connection member 9 made of cloth.

Figure 3:
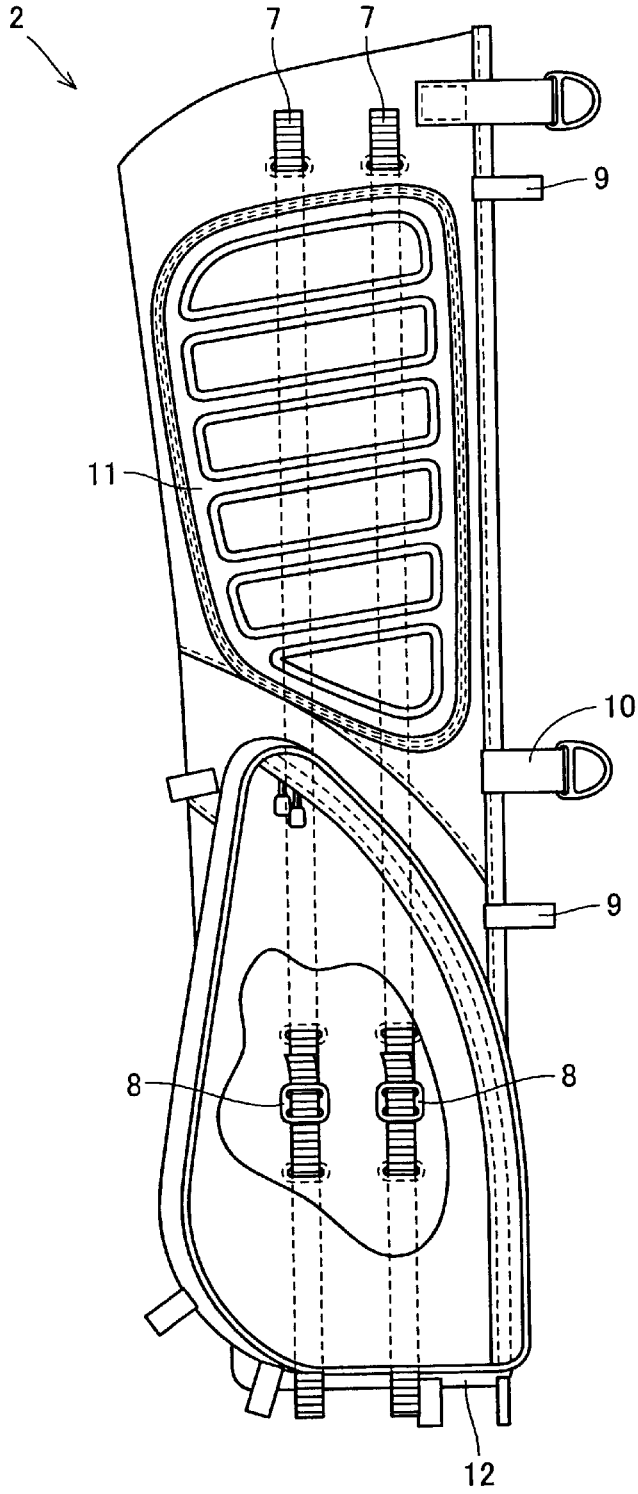
FIG. 3 is a side view of a body of the golf bag in one example of the present invention.

Referring to FIG. 3, an exemplary structure of body 2 of golf bag 1 is described. FIG. 3 is a side view of body 2 of golf bag 1.

As shown in FIG. 3, body 2 is tubular in shape and includes a tape 7, a pad 11, a base 12, connection member 9 for securing body 2 to frame 3, a shoulder belt attachment 10, and a fold-back portion 13 which is a part of the upper section of body 2 that is folded to cover an upper portion of frame 3.

Tape 7 is provided inside the body 2 for maintaining the shape of body 2. A plurality of tapes 7 are stretched between the top and bottom of frame 3. Tape 7 has a length adjuster (buckle) 8. By means of length adjuster 8, the length of tape 7 is adjusted to apply a predetermined tension to tape 7.

Connection member 9 secures body 2 to frame 3. Pad 11 in the example shown in FIG. 3 is attached to a side of body 2 and includes a shock-absorbing member. Base 12 constitutes the bottom of body 2.

Referring again to FIGS. 1 and 2, frame 3 is assembled from parts that are formed of metal pipes processed into predetermined shapes respectively. The parts of frame 3 are coupled to each other via joint members of plastic for example. The bottom portion of frame 3 has a bottom connecting portion 37.

A pressing member 4 is rotatably provided to bottom connecting portion 37. One end of a resilient member 5 is connected near the free end of pressing member 4. The other end of resilient member 5 is connected to a support member (stand) 6 which is described herein later. Support member 6 is rotatably attached to a connecting portion connecting struts to each other.

Figure 4:
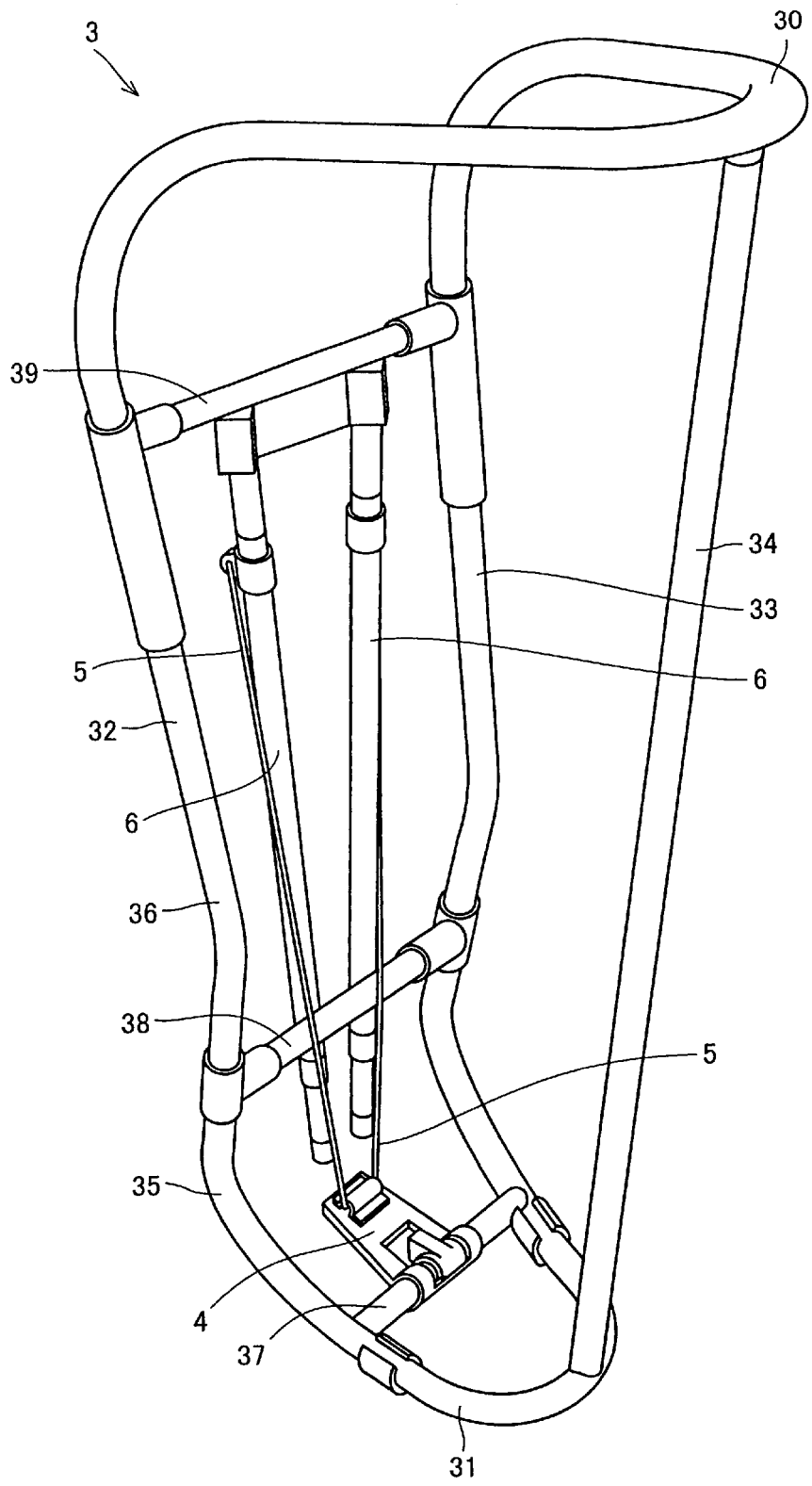
FIG. 4 is a perspective view of a frame in one example of the present invention as viewed from the front.
Figure 5:
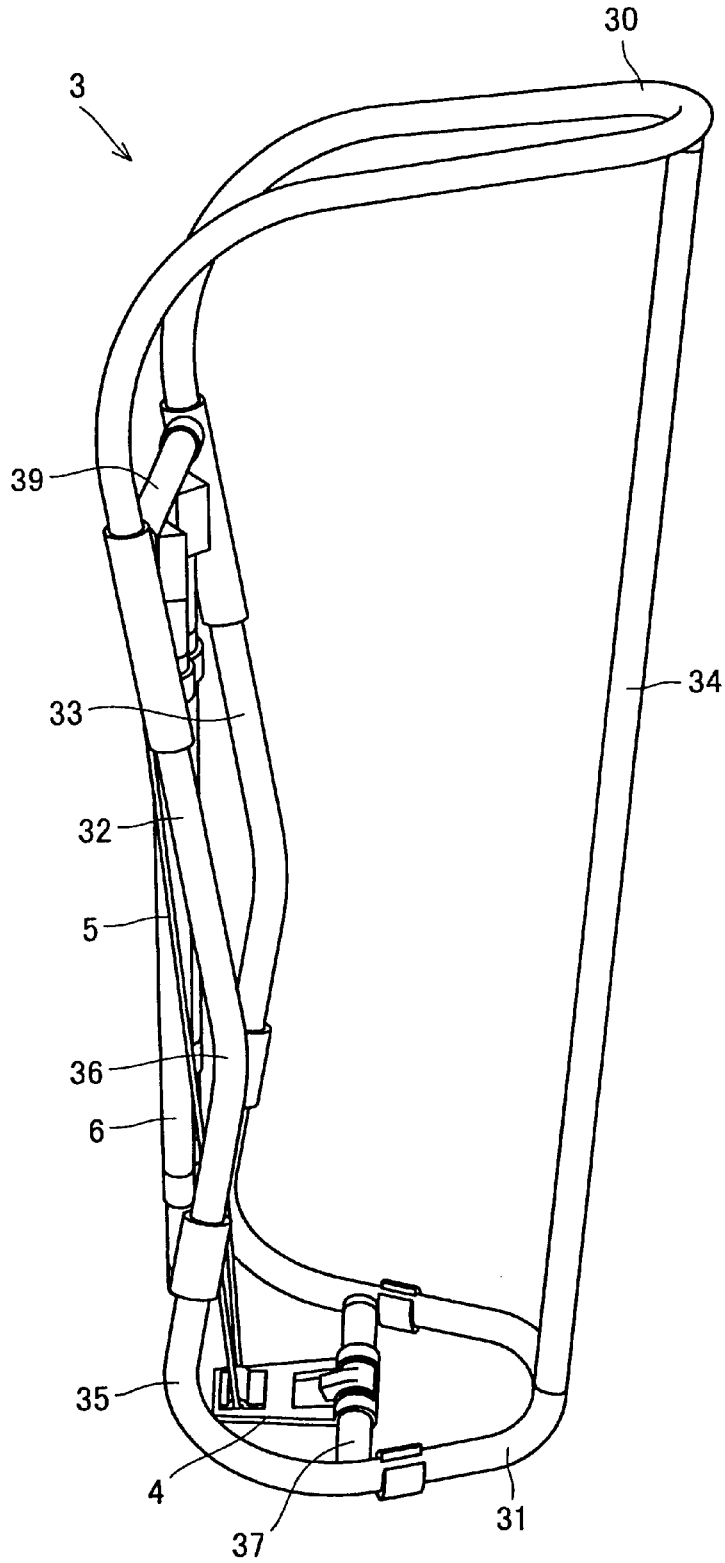
FIG. 5 is a perspective view of the frame in one example of the present invention as viewed from one side.
Figure 6:
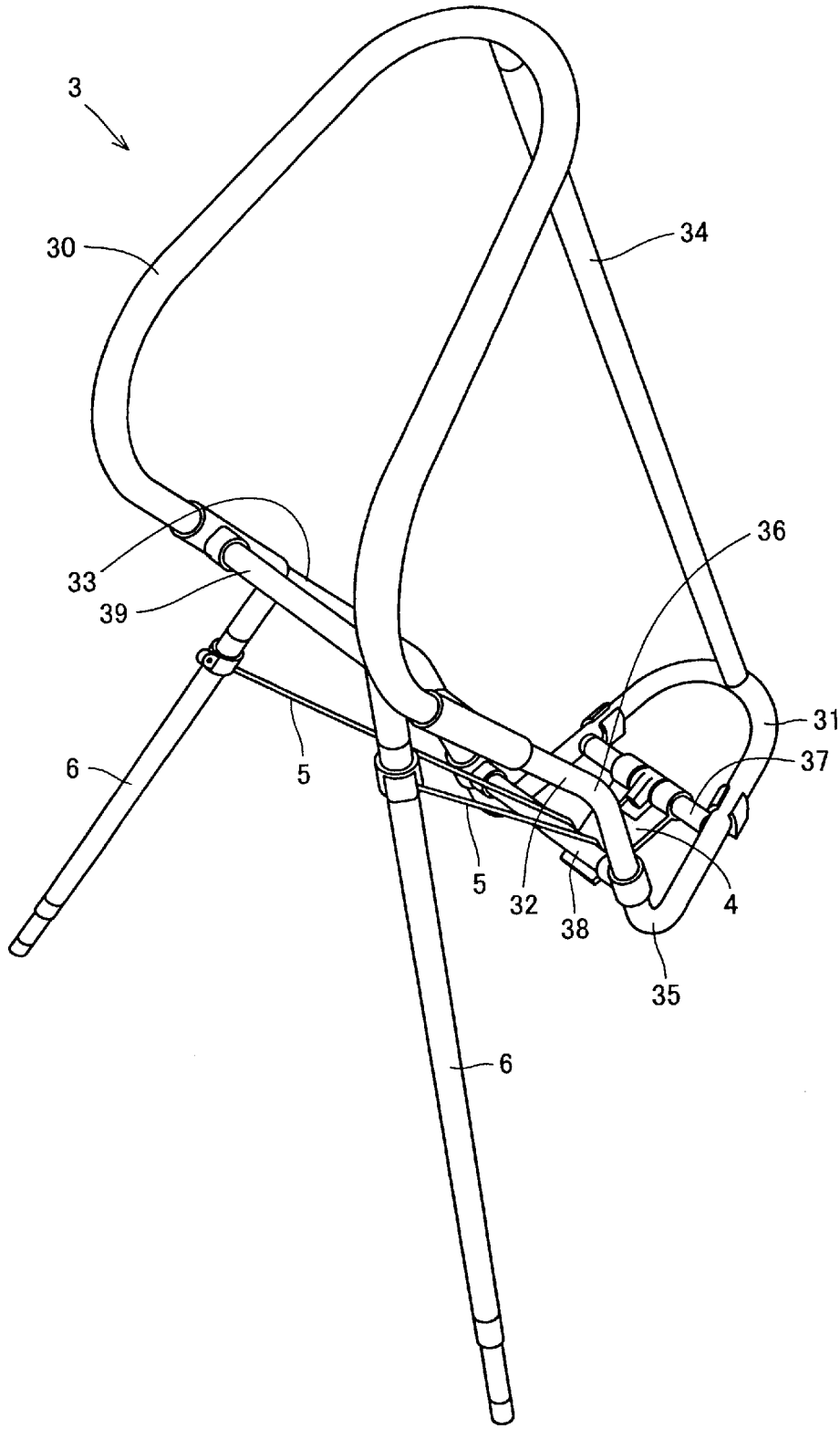
FIG. 6 is a perspective view of the frame in one example of the present invention in the state that a support member is extended out.
Figure 7:
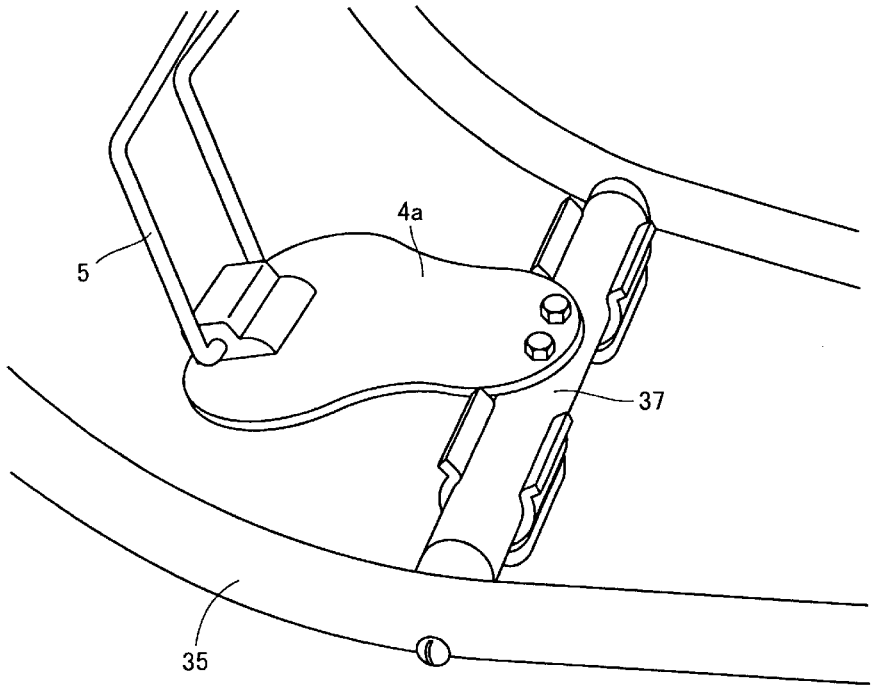
FIG. 7 is a perspective view of another example of a pressing member in one example of the present invention.

Referring to FIGS. 4–7, a structure of frame 3 of this example is described in detail. FIGS. 4 and 5 are each perspective view of frame 3 with support member 6 being retracted, FIG. 6 is a perspective view of frame 3 with support member 6 being opened or extended, and FIG. 7 is a perspective view showing a modification of pressing member 4.

As shown in FIGS. 4 and 5, frame 3 of this example includes a top portion 30, a bottom portion 31, and first to third struts 32, 33 and 34.

Top portion 30 and bottom portion 31 are nearly U-shaped to conform to the outside shape of the body 2 of the golf bag. Frame 3 having such a shape as described above is increased in strength and reduced in weight. Moreover, bottom portion 31 shaped as described above allows the standing state of frame 3 to be maintained stably.

The above-mentioned bottom connecting portion 37 is attached to bottom portion 31. Bottom connecting portion 37 is provided to extend across the space defined by bottom portion 31 of frame 3, and attached to the bottom portion 31 with screws for example.

First and second struts 32 and 33 located on the back side are curved in shape. The third strut 34 located on the front side is linear in shape. Curved portions (first curved portions) 35 are provided respectively to or near respective bottom ends of first and second struts 32 and 33. Moreover, curved portions (second curved portions) 36 are provided respectively to respective central portions in the vertical direction of first and second struts 32 and 33. Support member 6 is held in the space formed by curved portions 36 and first and second struts 32 and 33 located on both sides of the curved portions 36.

Between first and second struts 32 and 33, a central connecting portion 38 and an upper connecting portion 39 are attached. Central connecting portion 38 and upper connecting portion 39 are connected to first and second struts 32 and 33 via L-shaped or T-shaped plastic joint members for example.

Pressing member 4 is rotatably attached to bottom connecting portion 37. Pressing member 4 in this example is formed of a plastic rectangular plate. Here, as shown in FIG. 7, a pressing member 4*a* may be secured to bottom connecting portion 37 with such fastening members as screws and pressing member 4*a* may be formed of any flexible member so as to be deformable. Pressing member 4 is placed below curved portions 35.

Near the free end of pressing member 4, 4*a*, one end of resilient member 5 is connected. Resilient member 5 in this example is formed of a metal wire rod. The other end of resilient member 5 is connected to support member 6. A plastic ring member with a protruded part may be attached around support member 6 for inserting the other end of resilient member 5 into the protruded part of the ring member in order to secure the resilient member 5 to support member 6.

Support member 6 is rotatably attached to upper connecting portion 39. Support member 6 in this example is attached to the connecting portion via a plastic attachment. The attachment as shown in FIG. 1 has a tubular portion 14 for receiving therein one end of support member 6. In this state, support member 6 is rotatably secured to tubular portion 14. Tubular portion 14 has a notch 15 for allowing support member 6 to rotate.

An operation of extending/retracting support member 6 of golf bag 1 in this example is described below.

Golf bag 1 in the state shown in FIG. 2 is tilted backward (toward the left in FIG. 2) on and along curved portions 35. Then, pressing member 4 is pressed against the ground to rotate about bottom connecting portion 37. This rotation of pressing member 4 causes resilient member 5 to be pushed up and thus displaced upward relative to frame 3. If pressing member 4*a* is employed, pressing member 4*a* pressed against the ground is deformed and the deformation causes resilient member 5 to be pushed up and accordingly displaced upward relative to frame 3.

Then, resilient member 5 pushes up support member 6 and support member 6 accordingly rotates with respect to upper connecting portion 39. Here, the rotational axis of support member 6 is extended obliquely relative to the longitudinal direction of upper connecting portion 39 and thus support member 6 can be opened while being rotated with respect to upper connecting portion 39.

In this way, support member 6 is rotated and extended out of frame 3 and brought into the opened state as shown in FIG. 6. Then, the end of support member 6 is in contact with the ground and, in this state, support member 6 supports golf bag 1.

Golf bag 1 in the inclined state is then raised. Accordingly, resilient member 5 extending on the front side (on the right side in FIG. 5) of and in contact with the central connecting portion 38 draws support member 6. Support member 6 accordingly returns to the space between first and second struts 32 and 33 of frame 3 while being closed. Pressing member 4 is rotated in the reverse direction and returned to the initial state. When pressing member 4*a* is employed, pressing member 4*a* is returned from the deformed state to the initial state.

Here, as curved portions 36 are provided at respective central portions in the vertical direction of first and second struts 32 and 33 respectively, support member 6 is held in the space defined by the curved portions 36 and its nearby portions. Central connecting portion 38 serves as a stopper for support member 6.

Referring to FIGS. 8–15, another example of the present invention is described.

Figure 8:
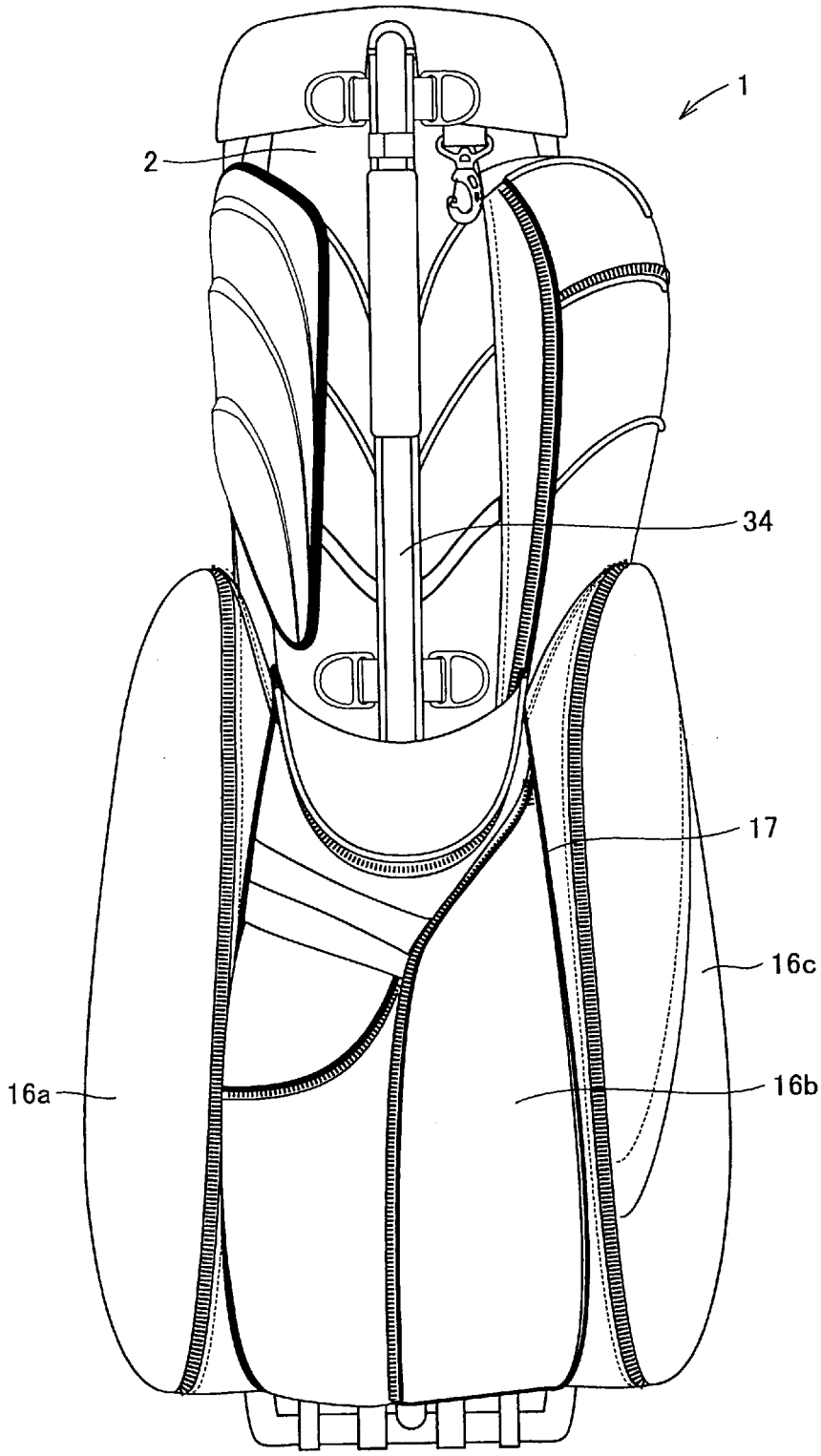
FIG. 8 is a front view of a golf bag in another example of the present invention.

As shown in FIG. 8, a golf bag 1 in this example has side pockets 16*a* and 16*c* on both sides respectively of a body 2 and further includes a center pocket 16*b* between the side pockets. Center pocket 16*b* is located on the front side with respect to a third strut 34 of a frame 3 and connected to body 2 via a fastener 17.

Figure 15:
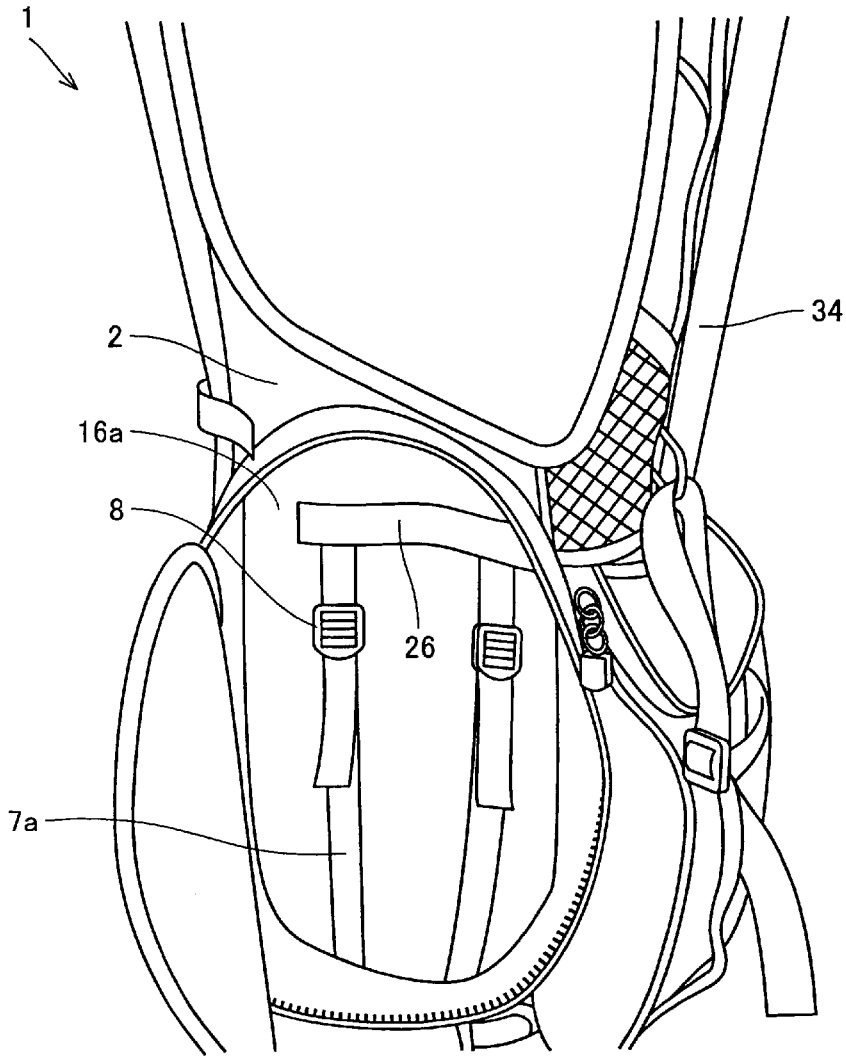
FIG. 15 shows an exemplary internal structure of a side pocket of the golf bag in another example of the present invention.
Figure 16:
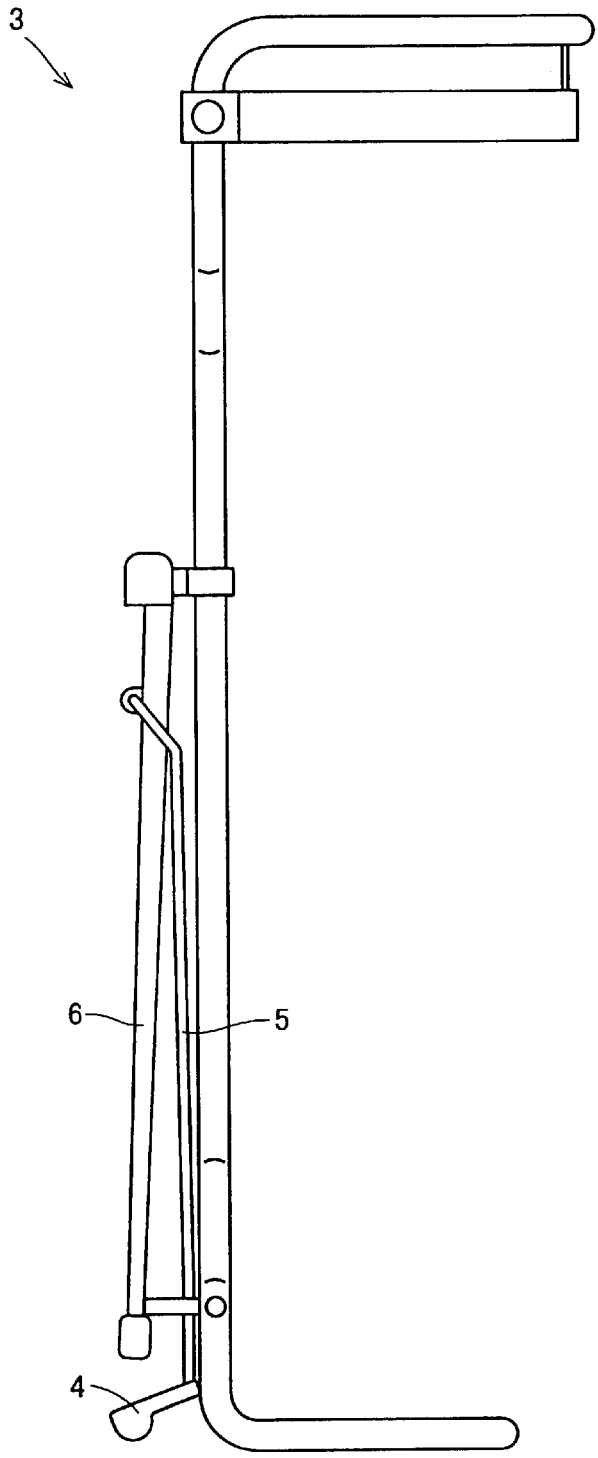
FIG.16 PRIOR ART
FIG. 16 is a side view of a conventional frame.

As shown in FIG. 15, two side tapes 7*a* are attached within side pocket 16*a*. Side tapes 7*a* extend in the vertical direction of body 2 and have length adjusters 8. Top and bottom ends of side tapes 7*a* are sewn to a side of body 2 that is located within side pocket 16*a*. Preferably, two side tapes 7*a* are similarly attached within side pocket 16*c*. A pair of reinforcing tapes 26 serving as reinforcing members are sewn to the side of body 2 to extend over the longitudinal top and bottom ends of side tapes 7*a*. Reinforcing tapes 26 extend in the direction substantially orthogonal to side tapes 7*a*.

Figure 12:
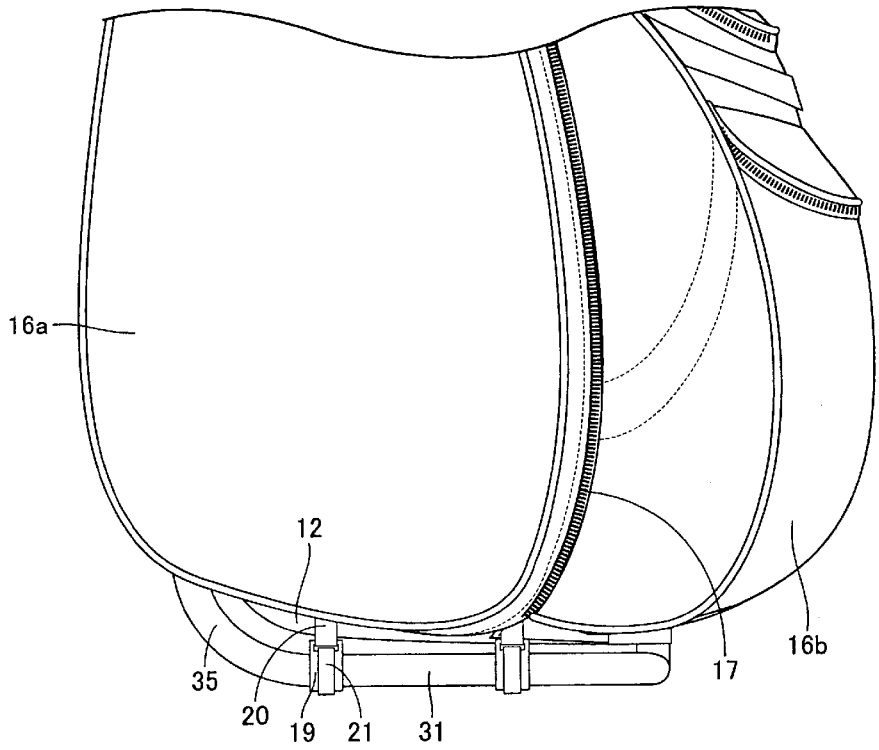
FIG. 12 is a partially enlarged side view of the golf bag in another example of the present invention.

As shown in FIG. 12, a plurality of legs 19 are attached to a bottom portion 31 of frame 3. Legs 19 made of plastic each have a substantially C-shaped cross section. A plurality of legs 19 are arranged at predetermined intervals on bottom portion 31. Accordingly, bottom portion 31 of frame 3 is stably supported at a plurality of places. In the example shown in FIG. 12, leg 19 has its central part provided with a protrusion 21 having a substantially planar surface and has its one end provided with a through hole.

A connection tape 20 serving as a connection member is inserted through the through hole mentioned above. One end of connection tape 20 is connected to body 2. Body 2 and frame 3 are thus connected to each other via connection tape 20 and leg 19.

Figure 13:
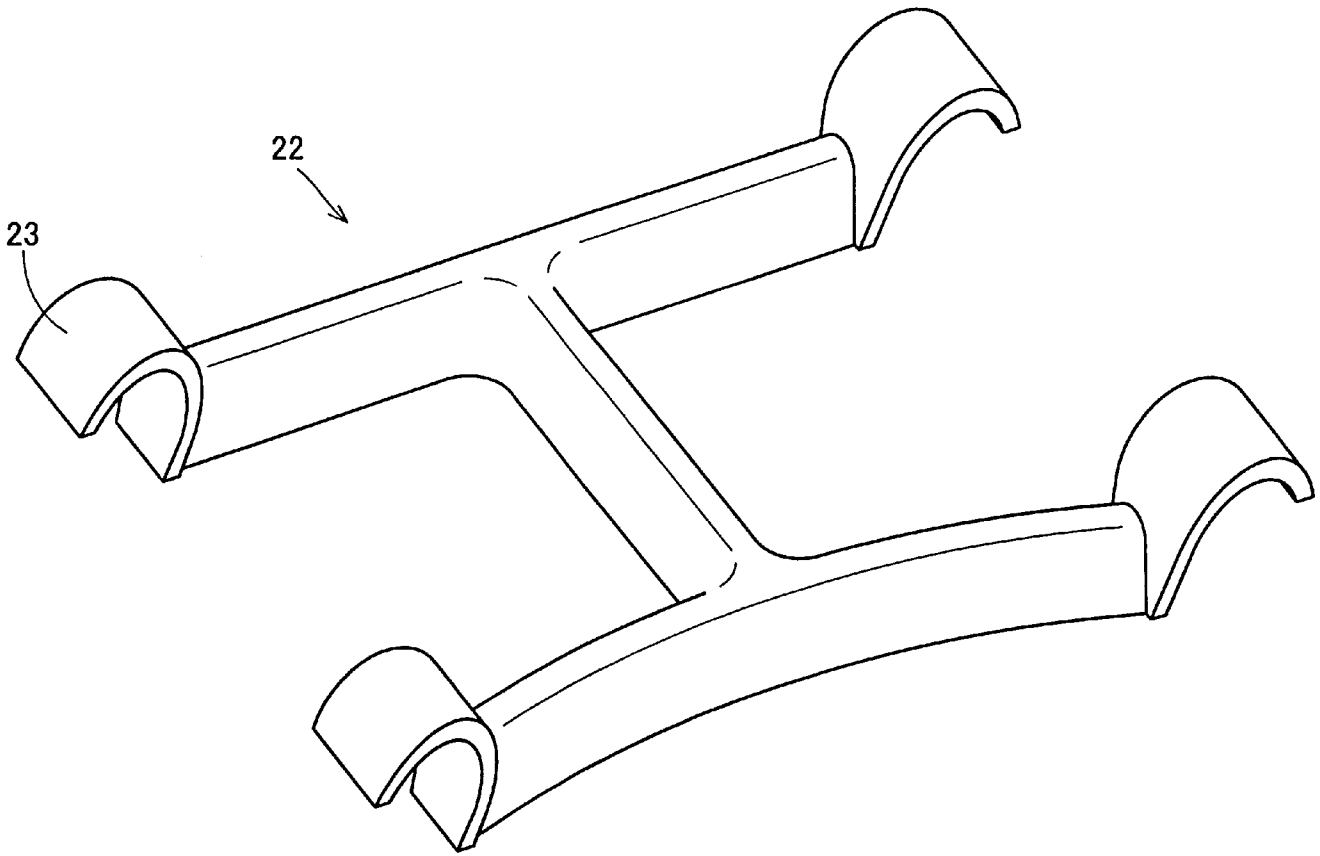
FIG. 13 is a perspective view of a partition employable for the golf bag in another example of the present invention.
Figure 14:
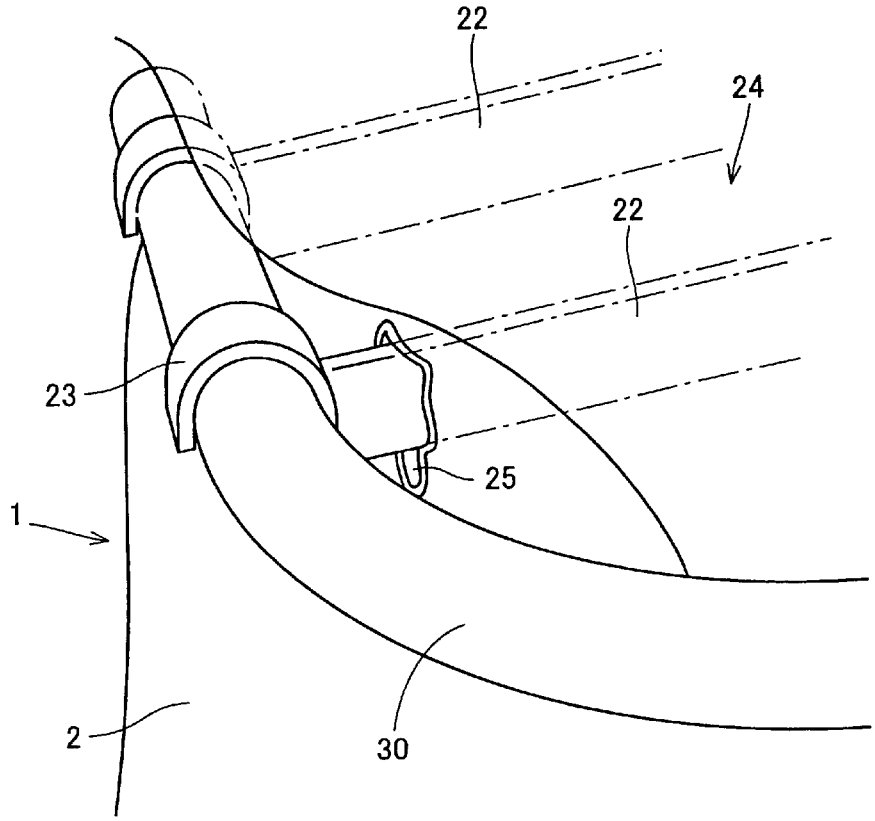
FIG. 14 is a partially enlarged perspective view of the golf bag in another example of the present invention.

Further, as shown in FIG. 14, a partition 22 is attached to a throat (top opening portion) 24 of body 2. Partition 22 made of plastic is substantially H-shaped as shown in FIG. 13. A hook-shaped engagement portion 23 is provided to an end of partition 22. As shown in FIG. 14, engagement portion 23 is mounted on a top portion 30 of frame 3 and engagement portion 23 and frame 3 are detachably engaged with each other.

Body 2 as shown in FIG. 14 has a through hole 25 for receiving a part of partition 22 that is located near an end of partition 22. Preferably, body 2 has a reinforcing portion around through hole 25 for preventing damage to body 2 that is caused because partition 22 is inserted through the through hole 25.

Structural details of golf bag 1 except for those discussed above are basically the same as those of the one example that has already been discussed.

Figure 9:
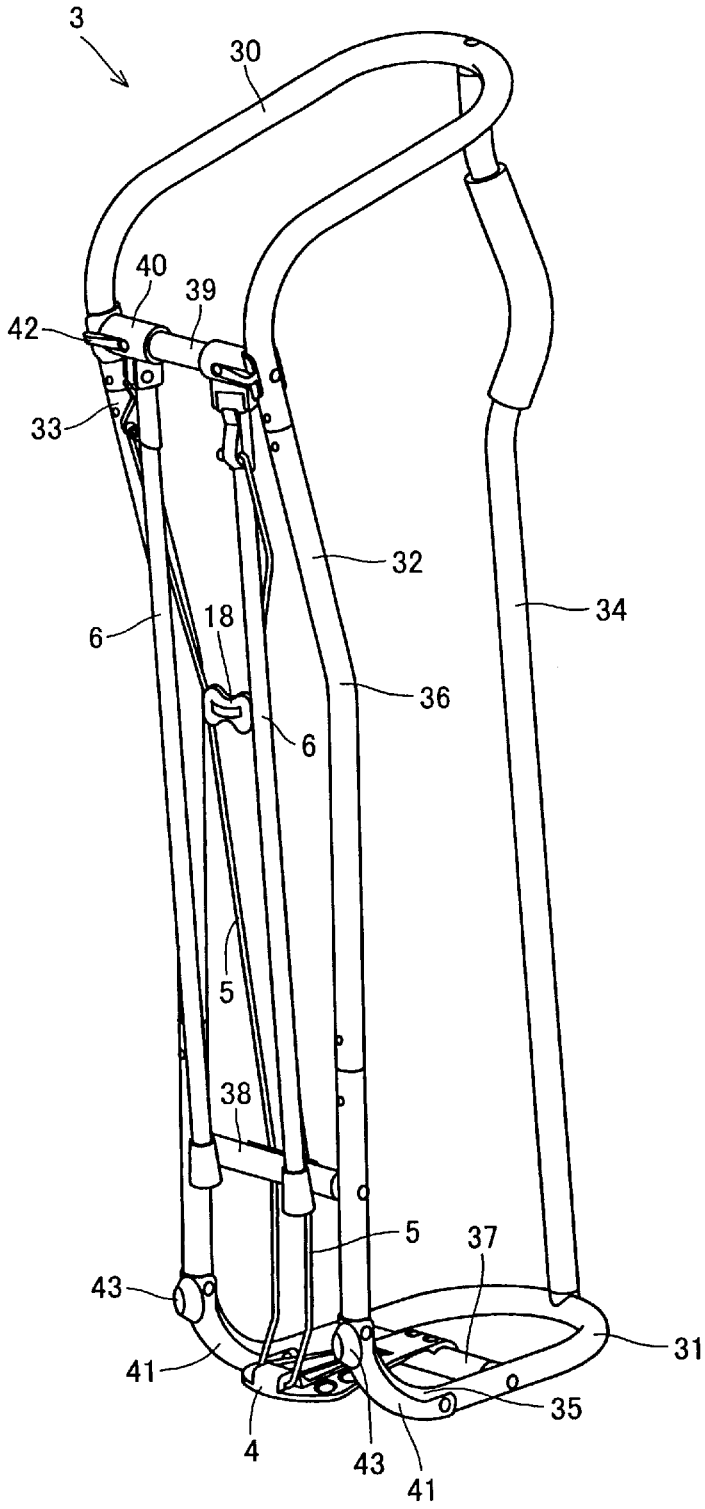
FIG. 9 is a perspective view of a frame in another example of the present invention.

Frame 3 in this example is described now. As shown in FIG. 9, frame 3 in this example is basically the same in structure as the above-discussed frame, except for some improvements.

Figure 11:
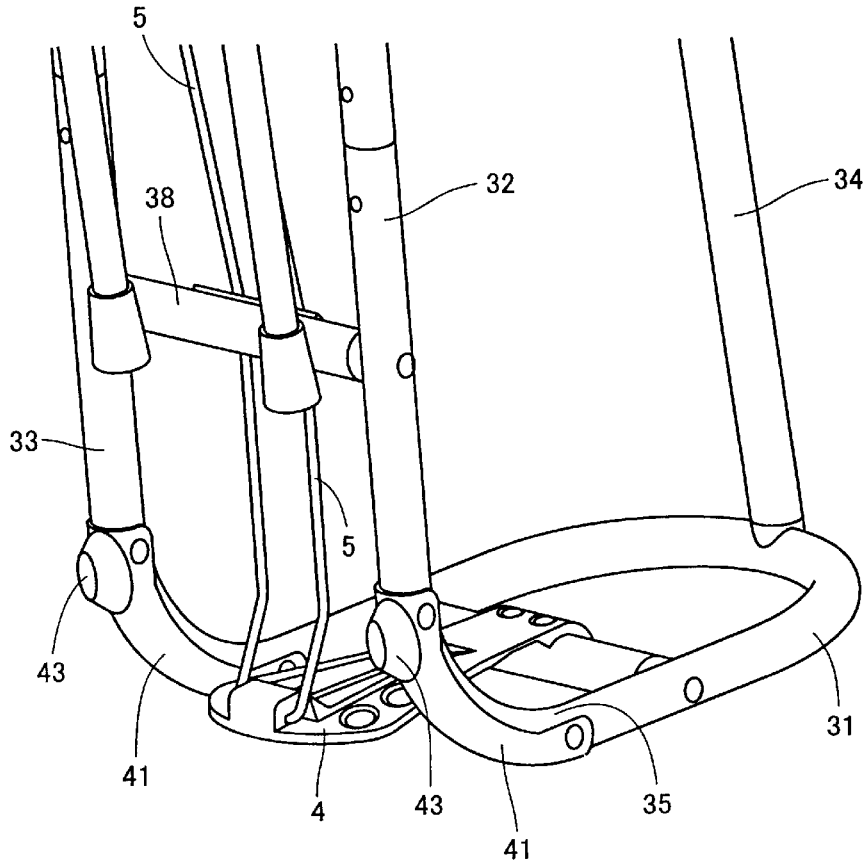

Referring to FIG. 9, to a curved portion (first curved portion) 35 located on bottom portion 31 of frame 3, a protection member (first protection member) 41 made of synthetic rubber is attached for supporting curved portion 35. As shown in FIG. 11, protection member 41 has a protrusion 43 attached to frame 3 with such fastening members as rivets to extend from bottom portion 31 and reach first or second struts 32 or 33. Protrusion 43 juts out backward and placed near the position immediately above curved portion 35.

Figure 10:
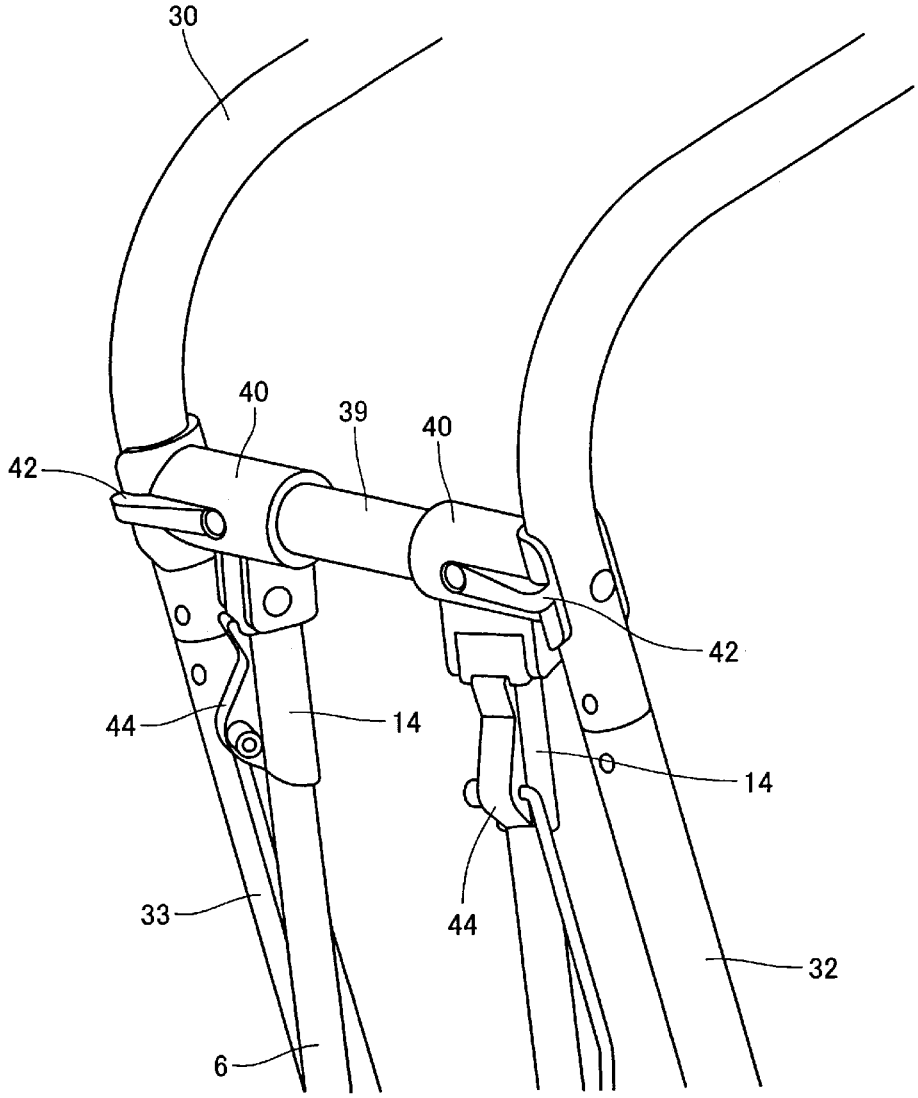
FIGS. 10 and 11 are each a partially enlarged view of the frame shown in FIG. 9.

Further, as shown in FIG. 9, a plastic protection member (second protection member) 40 is attached to an upper connecting portion (first connecting portion) 39. As shown in FIG. 10, protection member 40 includes a tubular section receiving an end of upper connecting portion 39 and a curved section contacting the outer surface of first or second strut 32 or 33. Protection member 40 in the example shown in FIGS. 9 and 10 is attached to frame 3 with rivets and has a protrusion (second protrusion) 42 on its surface.

In the example shown in FIGS. 9 and 10, an extending section extending downward from protection member 40 is provided. A notch is made in a part of the extending section and tubular section 14 is rotatably attached to the extending section with pins. One end of support member 6 is inserted into tubular section 14 and the pin is also inserted through one end of support member 6. Accordingly, support member 6 is rotatable about the pin on the notch side.

Protrusions 42 and 43 may serve as legs when golf bag 1 or frame 3 is laid horizontally or as supports when golf bag 1 or frame 3 is mounted on a (golf) cart.

According to this example, a through hole is provided in a protrusion 44 for receiving an end of resilient member 5 to be rotatable in the through hole. As shown in FIG. 9, resilient member 5 extends on the other side of support member 6 with respect to central connecting portion (second connecting portion) 38, namely extends in front of central connecting member 38. Further, in the example shown in FIG. 9, a connection member 18 is attached to resilient members 5 for holding right and left resilient members 5 in the state close to each other.

Regarding the golf bag according to the present invention, the pressing member and the mount portion where the pressing member is mounted can be protected by the frame and thus the pressing member and the mount portion are prevented from being damaged. Further, any load suddenly exerted on the pressing member when the golf bag is inclined can be prevented. This is effective in preventing the damage to the pressing member and the mount portion. Moreover, as the support member can be driven without collapsing the bottom of the body of the golf bag, shortening of the lifetime of the golf bag is also prevented.

In addition to the above-discussed effects, various effects as described below are achieved. As the frame is constructed of such a hard material as metal, golf clubs are protected and the golf bag is excellent in stability when being laid in the horizontal state and is hard to deform when secured to a (golf) cart with a bag-fastening tape. No top cuff or hard bottom is required for the body of the bag. The frame itself is easy to assemble and no special sewing machine is necessary for sewing the body of the bag.

In addition, the bag itself is detachable from the frame and thus the bag itself is easily replaced when damaged. Depending on conditions for intended use, a bag body of a different design may be employed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf bag comprising:

a body;

a frame receiving said body and having a bottom portion provided with a pair of first curved portions;

a pressing member attached to the bottom portion of said frame;

a resilient member having one end connected to said pressing member;

a support member connected to the other end of said resilient member and driven by being pressed via said resilient member by pressing member, wherein said pressing member is placed below said first curved portions; and first and second struts extending continuously from said bottom portion, wherein said first curved portions are provided respectively to respective connection parts between said first and second struts and said bottom portion.

2. The golf bag according to claim 1, wherein said frame has second curved portions forming a space for holding said support member in the space.

3. The golf bag according to claim 1, wherein said body has a tape stretched between a top portion and said bottom portion of said frame for maintaining a shape of said body.

4. The golf bag according to claim 3, further comprising a length adjuster to apply a predetermined amount of tension to said tape.

5. The golf bag according to claim 1, wherein said body is detachably attached to said frame.

6. The golf bag according to claim 1, further comprising a side tape having both ends secured to a side of said body and having a length adjuster adjusting the length to apply tension to said body.

7. The golf bag according to claim 6, wherein said body has its side provided with a pocket, and said side tape is placed within said pocket.

8. The golf bag according to claim 1, further comprising a partition attached to a top opening portion of said body, wherein said partition hits an engagement portion engaged detachably with a top portion of said frame.

9. The golf bag according to claim 8, wherein said body has a through hole through which said partition is inserted.

10. The golf bag according to claim 1, wherein a plurality of legs are attached to the bottom portion of said frame and said legs and said body are detachably connected to each other via respective connection members.

11. The golf bag according to claim 1, further comprising first protection members attached to said first curved portions respectively for protecting said first curved portions, wherein said first protection members have a first protrusion serving as legs when said body and said frame are laid horizontally, said frame has a first connecting portion connecting said first and second struts to each other near a top portion of said frame, a second protection member is attached to said first connecting portion, and said second protection member has a second protrusion serving as a leg when said body and said frame are laid horizontally.

12. The golf bag according to claim 1, wherein said frame has a central connecting portion connecting said first and second struts to each other above said first curved portions, and said resilient member extends on a side opposite to said support member with respect to said central connecting portion.

13. A frame receiving a body of a golf bag comprising:

a pair of first curved portions provided to a bottom portion;

a connecting portion provided to said bottom portion;

a pressing member placed below said first curved portions and attached to said connecting portion;

a resilient member having one end connected to said pressing member;

a support member connected to the other end of said resilient member and driven by being pressed via said resilient member by said pressing member; and first and second struts extending continuously from said bottom portion, wherein said first curved portions are provided respectively to respective connection parts between said first and second struts and said bottom portion.

14. The frame of the golf bag according to claim 13, further comprising second curved portions forming a space for holding said support member in the space.

15. The frame of the golf bag according to claim 13, further comprising first protection members attached to said first curved portion for protecting said first curved portions, a first connecting portion connecting said first and second struts to each other near a top portion of said frame, and a second protection member attached to said first connecting portion, wherein said first protection members have first protrusions serving as legs when said frame is laid horizontally, and said second protection member has a second protrusion serving as a leg when said frame is laid horizontally.

16. The frame of the golf bag according to claim 13, further comprising a second connecting portion connecting said first and second struts to each other above said first curved portions, wherein said resilient member extends on a side opposite to said support member with respect to said second connecting portion.

* * * * *